US007621351B2

(12) United States Patent
Clark et al.

(10) Patent No.: US 7,621,351 B2
(45) Date of Patent: Nov. 24, 2009

(54) REAMING TOOL SUITABLE FOR RUNNING ON CASING OR LINER

(75) Inventors: Lester I. Clark, The Woodlands, TX (US); John C. Thomas, Magnolia, TX (US); Jeffrey B. Lund, Salt Lake City, UT (US); Eric E. McClain, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/747,651

(22) Filed: May 11, 2007

(65) Prior Publication Data

US 2007/0289782 A1 Dec. 20, 2007

Related U.S. Application Data

(60) Provisional application No. 60/800,621, filed on May 15, 2006.

(51) Int. Cl.
*E21B 7/28* (2006.01)

(52) U.S. Cl. ..... 175/394; 175/406

(58) Field of Classification Search ..... 175/406, 175/394

See application file for complete search history.

(56) References Cited

U.S. PATENT DOCUMENTS

| | | | | |
|---|---|---|---|---|
| 1,342,424 | A | 6/1920 | Cotten | |
| 1,981,525 | A | 11/1934 | Price | |
| 1,997,312 | A | 4/1935 | Satre | |
| 2,215,913 | A | 9/1940 | Brown | |
| 2,334,788 | A | 11/1943 | O'Leary | |
| 2,869,825 | A | 1/1959 | Crawford | |
| 2,940,731 | A | 6/1960 | Poole | |
| 3,266,577 | A | 8/1966 | Turner | |
| 3,565,192 | A | 2/1971 | McLarty | |
| 3,624,760 | A | 11/1971 | Bodine | |
| 3,825,083 | A * | 7/1974 | Flarity et al. | 175/394 |

(Continued)

FOREIGN PATENT DOCUMENTS

| | | |
|---|---|---|
| CA | 1222448 | 6/1987 |

(Continued)

OTHER PUBLICATIONS

U.S. Appl. No. 11/764,008, filed Jun. 15, 2007, entitled "Cutting Elements for Casing Component Drill Out and Subterranean Drilling, Earth Boring Drag Bits and Tools Including Same and Methods of Use," by Danny E. Scott.

(Continued)

*Primary Examiner*—Hoang Dang
(74) *Attorney, Agent, or Firm*—TraskBritt

(57) ABSTRACT

A reaming tool includes a tubular body having a nose portion with a concave center. A plurality of blades defining junk slots therebetween extend axially behind the nose and taper outwardly from the exterior of the tubular body. Rotationally leading edges of the blades carry a plurality of cutting elements from the axially leading ends. Selected surfaces and edges of the blades bear tungsten carbide, which may comprise crushed tungsten carbide. The shell of the nose is configured to ensure drillout from the centerline thereof toward the side wall of the tubular body. A method of drilling out a reaming tool is also disclosed.

29 Claims, 6 Drawing Sheets

U.S. PATENT DOCUMENTS 3,997,009 A 12/1976 Fox
4,190,383 A 2/1980 Pryke et al.
4,255,165 A 3/1981 Dennis et al.
4,351,401 A 9/1982 Fielder
4,413,682 A 11/1983 Callihan et al.
4,618,010 A 10/1986 Falgout, Sr. et al.
4,624,316 A 11/1986 Baldridge et al.
4,673,044 A 6/1987 Bigelow et al.
4,682,663 A 7/1987 Daly et al.
4,759,413 A 7/1988 Bailey et al.
4,782,903 A 11/1988 Strange
4,842,081 A 6/1989 Parant
4,956,238 A 9/1990 Griffin
5,025,874 A 6/1991 Barr et al.
5,027,912 A 7/1991 Juergens
5,127,482 A 7/1992 Rector, Jr.
5,135,061 A 8/1992 Newton, Jr.
5,168,941 A 12/1992 Krueger et al.
5,186,265 A 2/1993 Henson et al.
5,259,469 A 11/1993 Stjernstrom et al.
5,271,472 A 12/1993 Leturno
5,285,204 A 2/1994 Sas-Jaworsky
5,289,889 A 3/1994 Gearhart et al.
5,311,954 A 5/1994 Quintana
5,314,033 A 5/1994 Tibbitts
5,322,139 A 6/1994 Rose et al.
5,341,888 A 8/1994 Deschutter
5,379,835 A 1/1995 Streich
5,402,856 A 4/1995 Warren et al.
5,423,387 A 6/1995 Lynde
5,435,403 A 7/1995 Tibbitts
5,443,565 A 8/1995 Strange, Jr.
5,450,903 A 9/1995 Budde
5,497,842 A 3/1996 Pastusek et al.
5,531,281 A 7/1996 Murdock
5,533,582 A 7/1996 Tibbitts
5,605,198 A 2/1997 Tibbitts et al.
5,706,906 A 1/1998 Jurewicz et al.
5,720,357 A 2/1998 Fuller et al.
5,765,653 A 6/1998 Doster et al.
5,787,022 A 7/1998 Tibbitts et al.
5,842,517 A 12/1998 Coone
5,887,655 A 3/1999 Haugen et al.
5,887,668 A 3/1999 Haugen et al.
5,950,747 A 9/1999 Tibbitts et al.
5,957,225 A 9/1999 Sinor
5,960,881 A 10/1999 Allamon et al.
5,979,571 A 11/1999 Scott et al.
5,992,547 A 11/1999 Caraway et al.
6,009,962 A 1/2000 Beaton
6,021,859 A 2/2000 Tibbitts et al.
6,050,354 A 4/2000 Pessier et al.
6,062,326 A 5/2000 Strong et al.
6,063,502 A 5/2000 Sue et al.
6,065,554 A 5/2000 Taylor et al.
6,073,518 A 6/2000 Chow et al.
6,098,730 A 8/2000 Scott et al.
6,123,160 A * 9/2000 Tibbitts ..... 175/385
6,131,675 A 10/2000 Anderson
6,298,930 B1 10/2001 Sinor et al.
6,321,862 B1 * 11/2001 Beuershausen et al. ..... 175/406
6,360,831 B1 3/2002 Akesson et al.
6,401,820 B1 6/2002 Kirk et al.
6,408,958 B1 6/2002 Isbell et al.
6,412,579 B2 7/2002 Fielder
6,415,877 B1 7/2002 Fincher et al.
6,439,326 B1 8/2002 Huang et al.
6,443,247 B1 9/2002 Wardley
6,460,631 B2 10/2002 Dykstra et al.
6,484,825 B2 * 11/2002 Watson et al. ..... 175/374
6,497,291 B1 12/2002 Szarka
6,510,906 B1 1/2003 Richert et al.
6,513,606 B1 2/2003 Krueger
6,540,033 B1 4/2003 Sullivan et al.
6,543,312 B2 4/2003 Sullivan et al.
6,568,492 B2 5/2003 Thigpen et al.
6,571,886 B1 6/2003 Sullivan et al.
6,606,923 B2 8/2003 Watson et al.
6,612,383 B2 9/2003 Desai et al.
6,620,308 B2 9/2003 Gilbert
6,620,380 B2 9/2003 Thomas et al.
6,622,803 B2 9/2003 Harvey et al.
6,626,251 B1 9/2003 Sullivan et al.
6,648,081 B2 11/2003 Fincher et al.
6,655,481 B2 12/2003 Findley et al.
6,659,173 B2 12/2003 Kirk et al.
6,672,406 B2 1/2004 Beuershausen
6,702,040 B1 3/2004 Sensenig
6,702,045 B1 3/2004 Elsby
6,708,769 B2 3/2004 Haugen et al.
6,747,570 B2 6/2004 Beique et al.
6,779,613 B2 8/2004 Dykstra et al.
6,779,951 B1 8/2004 Vale et al.
6,817,633 B2 11/2004 Brill et al.
6,848,517 B2 2/2005 Wardley
6,857,487 B2 2/2005 Galloway
6,983,811 B2 1/2006 Wardley
7,025,156 B1 4/2006 Caraway
7,036,611 B2 5/2006 Radford et al.
7,044,241 B2 5/2006 Angman
7,066,253 B2 6/2006 Baker
7,096,982 B2 8/2006 McKay et al.
7,117,960 B2 10/2006 Wheeler et al.
7,137,460 B2 11/2006 Slaughter et al.
7,178,609 B2 2/2007 Hart et al.
7,204,309 B2 4/2007 Segura et al.
7,216,727 B2 5/2007 Wardley
7,367,410 B2 5/2008 Sangesland
2002/0112894 A1 * 8/2002 Caraway ..... 175/385
2004/0245020 A1 12/2004 Giroux et al.
2005/0145417 A1 7/2005 Radford et al.
2005/0152749 A1 7/2005 Anres et al.
2005/0183892 A1 * 8/2005 Oldham et al. ..... 175/402
2006/0070771 A1 4/2006 McClain et al.
2007/0079995 A1 * 4/2007 McClain et al. ..... 175/426

FOREIGN PATENT DOCUMENTS

CA 2411856 A1 12/2001
DE 4432710 C1 4/1996
EP 0028121 A1 5/1981
EP 1006260 B1 4/2004
GB 2086451 A 5/1982
GB 2170528 A 8/1986
GB 2345503 A 7/2000
GB 2351987 A 1/2001
GB 2396870 A 7/2004
WO 9325794 A1 12/1993
WO WO 9628635 A1 9/1996
WO 9813572 A1 4/1998
WO 9936215 A1 7/1999
WO WO 9937881 A2 7/1999
WO 0050730 A1 8/2000
WO 0142617 A1 6/2001
WO 0146550 A1 6/2001
WO 0194738 A1 12/2001
WO 0246564 A2 6/2002
WO 03087525 A1 10/2003
WO 2004076800 A1 9/2004
WO 2004097168 A1 11/2004
WO 2005071210 A1 8/2005

WO WO 2005083226 A1 9/2005

OTHER PUBLICATIONS

U.S. Appl. No. 11/928,956, filed Oct. 30, 2007, entitled "Earth Boring Drill Bits with Casing Component Drill Out Capability and Methods of Use," by Eric E. McClain et al.
Galloway, Gerg, Weatherford International, "Rotary Drilling with Casing—A Field Proven Method of Reducing Wellbore Construction Cost," World Oil Casing Drilling Technical Conference, Mar. 6-7, 2003, pp. 1-7 (WOCD-0306-02).
McKay, Dave, et al., Weatherford, "New Developments in the Technology of Drilling with Casing: Utilizing a Displaceable DrillShoe Tool," World Oil Casing Drilling Technical Conference, Mar. 6-7, 2003, pp. 1-11 (WOCD-0306-05).
PCT International Search Report for PCT Application No. PCT/US2006/036855, mailed Feb. 1, 2007.
PCT International Search Report for PCT Application No. PCT/US2005/004106, mailed Jul. 15, 2005.
PCT International Search Report for PCT Application No. PCT/US2007/011543, mailed Nov. 19, 2007.
Baker Oil Tools Drill Down Float Shoes, 6 pages, various dates prior to May 23, 1997.
Caledus BridgeBUSTER Product Information Sheet, 3 pages, 2004.
Downhole Products plc, Davis-Lynch, Inc. Pen-o-trator, 2 pages, no date indicated.
Ray Oil Tool, The Silver Bullet Float Shoes & Collars, 2 pages, no date indicated.
Weatherford Cementation Products, BBL Reamer Shoes, 4 pages, 1998.
PCT International Search Report, mailed Feb. 2, 2009, for International Application No. PCT/US2008/066300.

* cited by examiner

REAMING TOOL SUITABLE FOR RUNNING ON CASING OR LINER

RELATED APPLICATION

This application claims the benefit of U.S. Provisional Patent Application Ser. No. 60/800,621 filed May 15, 2006, and the disclosure of such application is incorporated herein in its entirety by reference.

FIELD OF THE INVENTION

Embodiments of the invention relate to a reaming tool suitable for running on casing or liner, and a method of reaming a bore hole.

BACKGROUND

When running casing or liner into a predrilled bore hole, it is desirable that the bore hole will have been drilled with intended cylindricity, to its designed diameter, and without marked deviations, such as doglegs, along its path. Unfortunately, due to transitions between formations, irregularities such as stringers within a formation, the use of out-of-tolerance drill bits, damage to drill bits after running into the bore hole, bottom hole assembly (BHA) configurations employed by the driller, and various other factors, the ideal bore hole is rarely achieved.

Therefore, it is desirable to provide the casing or liner being run into the existing bore hole with a cutting structure at the leading end thereof to enable enlargement, as necessary, of portions of the bore hole so that the casing or liner may be run into the bore hole to the full extent intended. Various approaches have been attempted in the past to provide a casing or liner string with a reaming capability, with inconsistent results.

BRIEF SUMMARY OF THE INVENTION

Embodiments of the reaming tool of the invention comprise a substantially tubular body having a concave nose portion extending to a side wall through a substantially arcuate shoulder transition region. The reaming tool further comprises cutting structure for enlarging, also termed "reaming," of a bore hole through contact with the side wall thereof. The term "tool" is used herein in a non-limiting sense, and the apparatus of embodiments of the present invention may also be characterized as a reaming bit or reaming shoe.

In some embodiments, the concave nose portion of the reaming tool may have at least one port therethrough extending to an interior of the body. In some embodiments, a plurality of circumferentially spaced, spirally configured blades may extend on an exterior of the body from proximate the shoulder transition region and define junk slots therebetween. An axially leading end of each blade may commence with substantially no standoff from the body and taper radially outwardly to a portion having a substantially constant standoff and having a radially inwardly extending, beveled, axially trailing end. A plurality of cutting elements may be disposed along a rotationally leading edge of each blade of the plurality proximate an axially leading end thereof.

Another embodiment of the invention comprises a method of drilling out a reaming tool configured as a shoe having a nose at an axially leading end thereof and a side wall extending axially to the rear thereof. The method comprises initially engaging the nose proximate a central portion thereof with a drill bit, rotating the drill bit inside the reaming tool, and drilling out the nose from the central portion thereof radially outwardly toward a periphery thereof and the side wall of the body.

DESCRIPTION OF THE INVENTION

Figure 1:
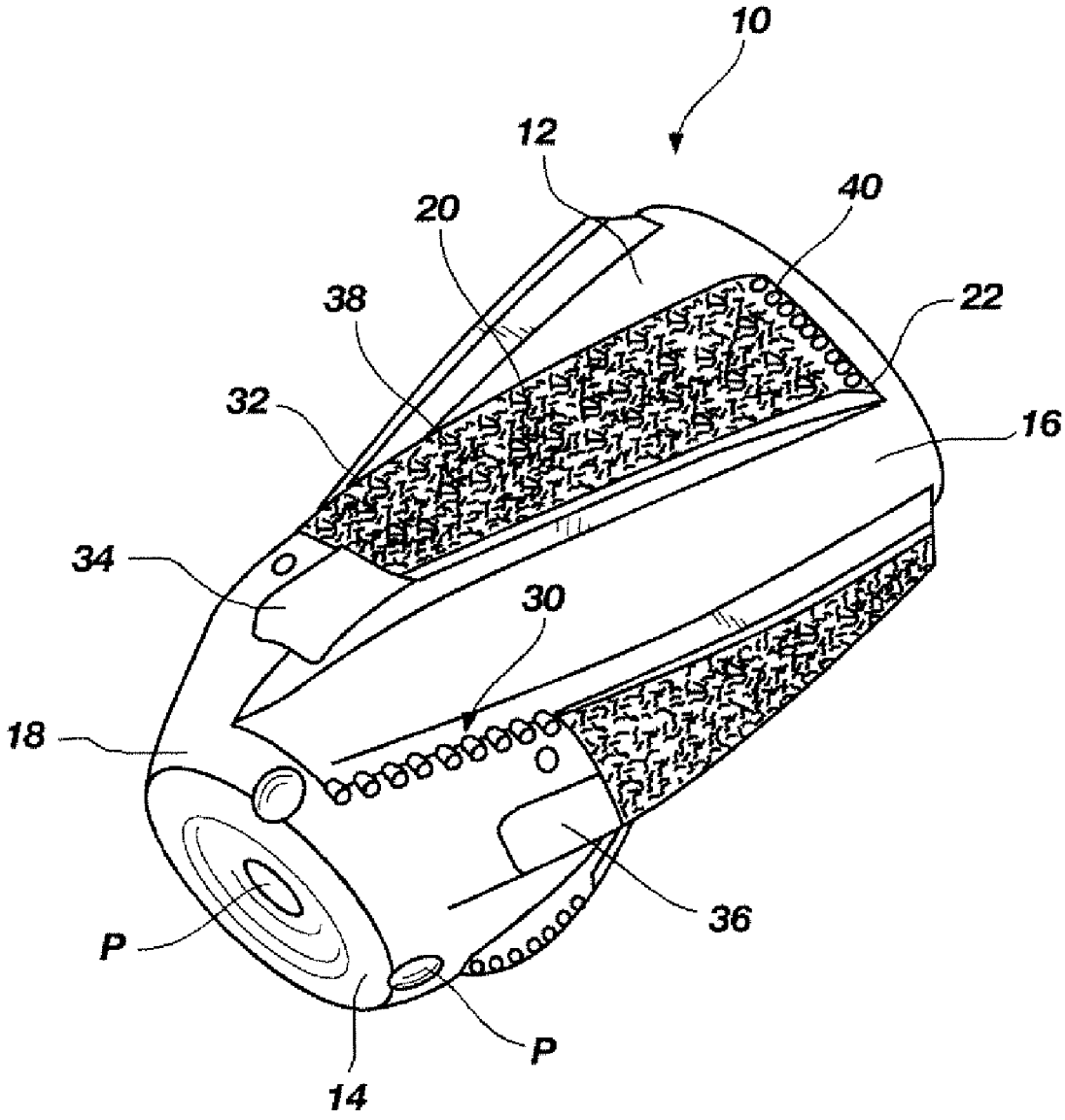
FIG. 1 is a perspective view of an embodiment of a reaming tool according to the present invention.

An embodiment of the present invention comprises a reaming tool, configured as a reaming bit or shoe, suitable for running on a casing or liner string (hereinafter referred to for the sake of convenience as a "casing string" to encompass such general type of tubular string). The reaming tool includes a tubular body having structure at a trailing end thereof for connecting the body to the leading end of a casing string and extending toward a nose at the leading end thereof.

The nose is configured with a shallow cone profile surrounding the center thereof, and a plurality of blades extend in a steeply pitched spiral configuration from a periphery of the nose, commencing at their leading ends with substantially no standoff from the body, toward the trailing end of the body. The blades taper axially and radially outwardly from the periphery of the nose to a greater, substantially constant standoff from the body to a location proximate their axially trailing ends and defining junk slots therebetween. The center of the nose includes a port therein through which drilling fluid (and, later, cement) may be circulated downwardly through the casing string, out onto the face of the nose and into the junk slot, which circulation may be enhanced through the use of additional side ports through the periphery of the nose from the interior of the body.

The rotationally leading edges (taken in the direction of intended rotation, conventionally clockwise, of the casing string when rotational reaming is contemplated) of each blade between the leading end thereof and a point at which the blade reaches full diameter are provided with a plurality of superabrasive cutting elements, which may comprise polycrystalline diamond compact (PDC) cutting elements facing in the direction of intended rotation. The PDC cutting elements are set outside the pass through diameter of a drill bit intended to be later run into the reaming tool for drillout, to facilitate the drillout process. Cutting elements of other materials, such as, for example, tungsten carbide (WC) may also be employed if suitable for the formation or formations to be encountered, these cutting elements again being set outside the pass through diameter. Radially outer faces of the blades along the tapered portion thereof are provided with a relatively thick layer of crushed tungsten carbide, placed rotationally behind the PDC cutting elements. Bearing elements in the form of, for example, tungsten carbide or PDC ovoids are disposed in recesses in the exterior surfaces of the blades, in the tapered portions thereof, the ovoids being overexposed (extending farther from the radially outer surface of the blades) than the PDC cutting elements and in locations rotationally behind the PDC cutting elements. The bearing elements and their relative exposure prevent potentially damaging contact between the PDC cutting elements and the interior of a larger tubular conduit through which the casing string is run before encountering the open, predrilled bore hole. The radially outer surfaces of the blades axially trailing the tapered portions bearing the PDC cutting elements are provided with a layer of tungsten carbide, at least along the rotationally leading and trailing edges of the blades. The longitudinally trailing ends of the blades may be tapered axially and radially inwardly toward the body, and provided with a relatively thick layer of crushed tungsten carbide.

The interior profile of the body is configured to optimize drillout by conventional rotary bits without leaving large segments of material of the remaining tool nose in the bore hole.

Figure 2:
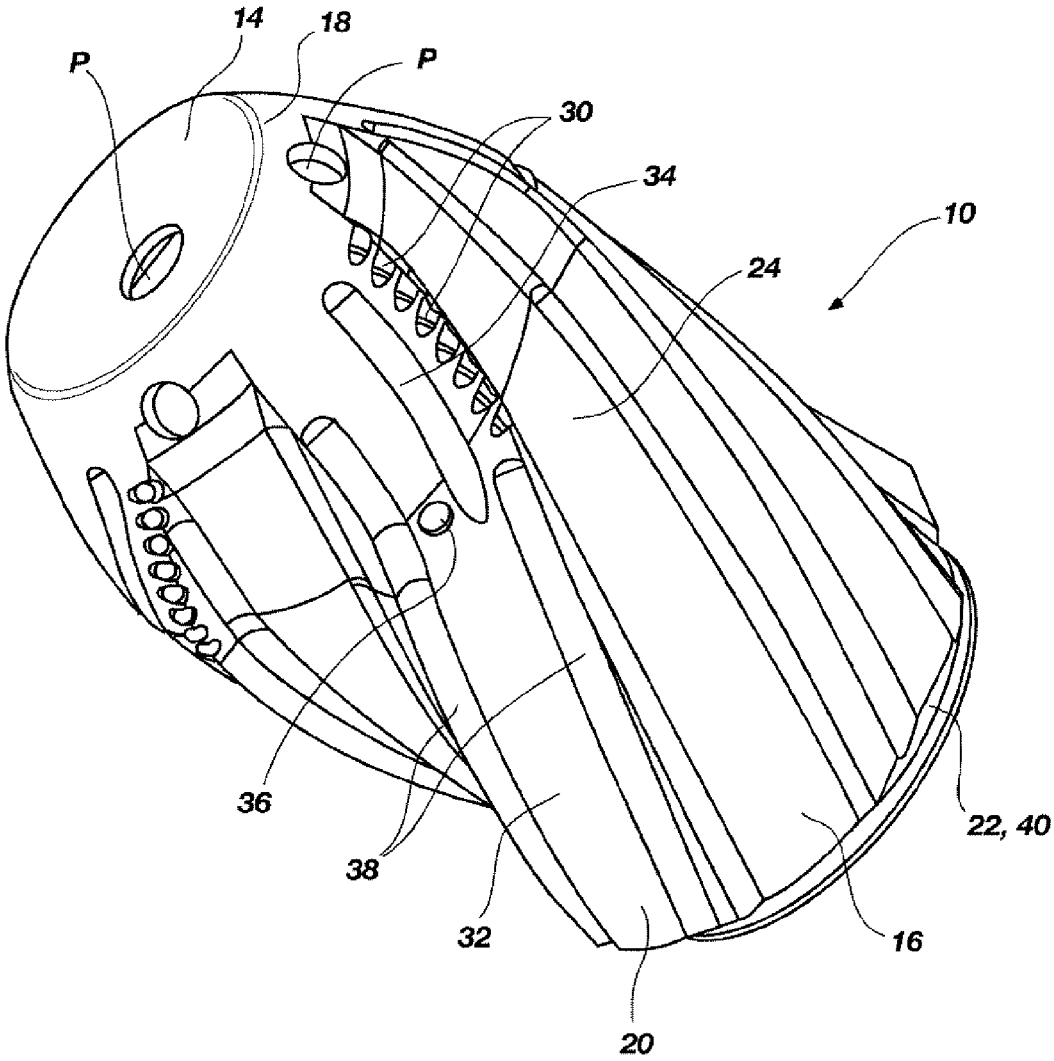
FIG. 2 is a perspective view of another embodiment of a reaming tool according to the present invention.
Figure 3:
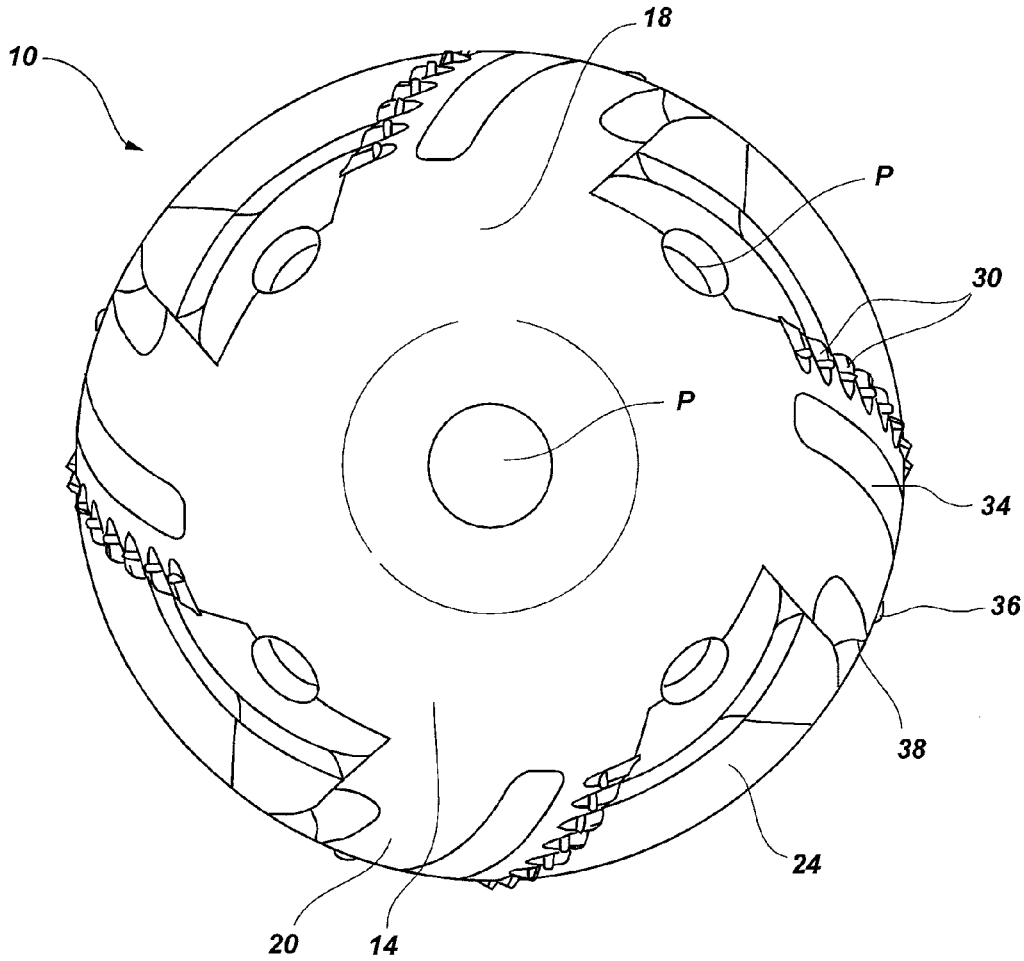
FIG. 3 is a frontal elevation, looking toward the nose of the reaming tool of FIGS. 1 and 2.
Figure 4:
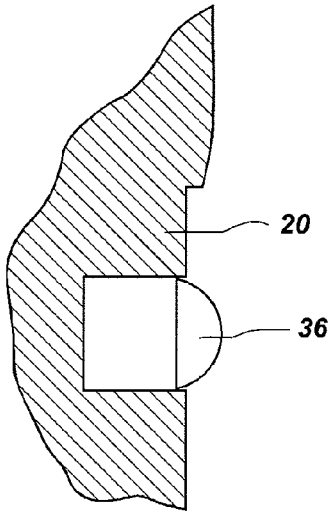
FIG. 4 is an enlarged, side sectional elevation depicting an ovoid-ended insert disposed in a blade of the reaming tool of FIGS. 1 and 2 and protruding beyond the major diameter of the tool.

Referring now to FIGS. 1 through 4 of the drawings, reaming tool 10 (in two slightly different embodiments, as respectively depicted in FIGS. 1 and 2) comprises tubular body 12, which may be formed of a single material, such as steel, aluminum, bronze or other suitably hard metal or alloy which is, nonetheless, easily drillable by conventional PDC or roller cone drill bits. The body 12 includes a nose 14, which may be configured with a shallow, concave profile recessed toward the centerline of the reaming tool 10. The concave profile may be a shallow cone, or other suitable concave profile. The nose 14 transitions into a side wall 16, which tapers axially and radially outwardly toward a trailing end of body 10, which is provided with structure, such as internal threads (not shown) for connecting reaming tool 10 to the leading end of a casing string. The transition between the nose 14 and side wall 16 comprises a transition shoulder wall 18 of substantially arcuate cross-section and which may or may not exhibit a constant radius of curvature. A central port, P opens from the interior of body 12 to the exterior on the nose 14, and additional side ports P extend from the exterior to the interior of body 12 through transition shoulder wall 18.

A plurality of blades 20 is disposed on the exterior of tubular body 12, extending from a location proximate the trailing edge of the transition shoulder wall 18 with no standoff therefrom, and increasing in standoff as they taper radially outwardly as they extend toward their respective axially trailing ends to provide a radially outer surface of increasing diameter. The axially trailing ends of the blades 20 comprise beveled or chamfered surfaces 22 of decreasing diameter, extending to the exterior of the body 12. The blades 20 are configured in a steeply pitched, spiral configuration on the exterior of the body 12, the circumferential extent of each blade 20 being great enough to ensure complete, 360° coverage of the exterior of body 12 by the plurality of blades 20. Junk slots 24 are defined on the exterior of side wall 16, from a position proximate transition shoulder wall 18, each junk slot 24 being circumferentially aligned with a side port P. Junk slots 24 initially increase in depth from their respective leading ends, following the increase in standoff of blades 20 and being defined between the side edges of the latter.

Superabrasive cutting elements in the form of PDC cutting elements 30 are disposed along the rotationally leading edges of each blade 20. The PDC cutting elements 30 may comprise any suitable PDC cutting element configuration. One nonlimiting example of a suitable PDC cutting element is disclosed in U.S. Pat. No. 5,435,403, assigned to the Assignee of the present invention. As noted above, the PDC cutting elements 30 are set outside the pass through diameter of a drill bit intended to be later run into the reaming tool 10 for drillout, to facilitate the drillout process. It is also contemplated that superabrasive cutting elements other than PDC cutting elements, as well as cutting elements of other materials, may be employed in implementing the present invention. For example, thermally stable product (TSP) diamond cutting elements, diamond impregnated cutting segments, cubic boron nitride (CBN) cutting elements and tungsten carbide (WC) cutting elements may be utilized, in consideration of the characteristics of the formation or formations being reamed and the ability to employ relatively less expensive cutting elements when formation characteristics permit.

Radially outer surfaces 32 of the blades 20 along the tapered portion thereof are provided with a relatively thick layer of crushed tungsten carbide 34, placed rotationally behind the PDC cutting elements 30. In the embodiment of FIG. 1, the layer of crushed tungsten carbide 34 is relatively circumferentially wide, axially short and commences axially above about the mid-point of the row of PDC cutting elements 30, while in the embodiment of FIG. 2 it is placed in an elongated groove extending axially at least along the entire axial extent of PDC cutting elements 30. Bearing elements 36 in the form of, for example, tungsten carbide ovoids are disposed in recesses in the exterior surfaces of the blades 20, in the tapered portions thereof, circumferentially between the PDC cutting elements 30 and the relatively thick layer of crushed tungsten carbide 34. It is also contemplated that other types and configurations of bearing elements may be employed, such as, for example, hemispherically headed PDC bearing elements, or bearing elements formed of other suitable materials. The radially outer surfaces 32 of blades 20 axially trailing the PDC cutting elements 30 are provided with one or more layers of tungsten carbide 38. In the embodiment of FIG. 1, a layer of tungsten carbide 38 extends substantially over the entire radially outer surface 32 of each blade 20, while in the embodiment of FIG. 2 the tungsten carbide is substantially disposed in two elongated layers 38 in grooves extending along rotationally leading and trailing edges of blades 20, the rotationally trailing layer of tungsten carbide 38 extending axially toward nose 14 so as to extend rotationally behind the relatively thick layer of tungsten carbide 34 with bearing elements 36 lying circumferentially therebetween. The axially trailing, beveled surfaces 22 at the ends of the blades 20 are provided with a relatively thick layer of crushed tungsten carbide 40.

The nose 14 of the reaming tool 10 is configured with an analytically derived shell (wall) thickness, selected for ease of drillout. A minimum thickness is designed by finite element analysis (FEA) for the intended weight and torque to be applied to the reaming tool 10 during use. The thickness is optimized so that the design affords a safety factor of 2 to 3 over the desired loading parameters under which reaming tool 10 is to be run.

The concavity of the nose 14 may be varied in degree, providing the reaming tool 10 the ability to guide itself through a formation while allowing the nose portion to be drilled out without leaving large segments of material in the bore hole. It is also notable that the absence of blades 20 in the nose area projecting above the face of the nose 14 allows for an uninterrupted cut of material of the body shell in the nose, making the reaming tool 10 PDC bit-drillable.

As noted previously, the bearing elements 36, comprising tungsten carbide ovoid-ended inserts or formed of other suitable materials, are overexposed with respect to the PDC cutting elements 30 as well as to the tungsten carbide layer 38, to prevent damaging contact between the superabrasive cutting elements carried on blades 20 and the interior of casing or liner through which reaming tool 10 may be run.

The provision of both PDC cutting elements 30 as well as tungsten carbide layers 34, 38 and 40 enables rotational or reciprocating reaming. Full circumferential coverage of the carbide layers 34, 38 and 40 enables reciprocating reaming. The PDC cutting elements 30 enable aggressive, rotational reaming in a conventional (clockwise) direction. The carbide layers 34 and, 38, which extend to the top of the gage on both the rotationally leading and trailing edges of the blades 20, allow the reaming tool 10 to ream in a counterclockwise rotational direction as well. Blades 20 also incorporate tapered, rotationally leading edges to reduce reactive torque and reduce sidecutting aggressiveness. The thick layer of crushed tungsten carbide 40 on the axially trailing ends of the blades 20 provides an updrill reaming capability.

Figure 5A:
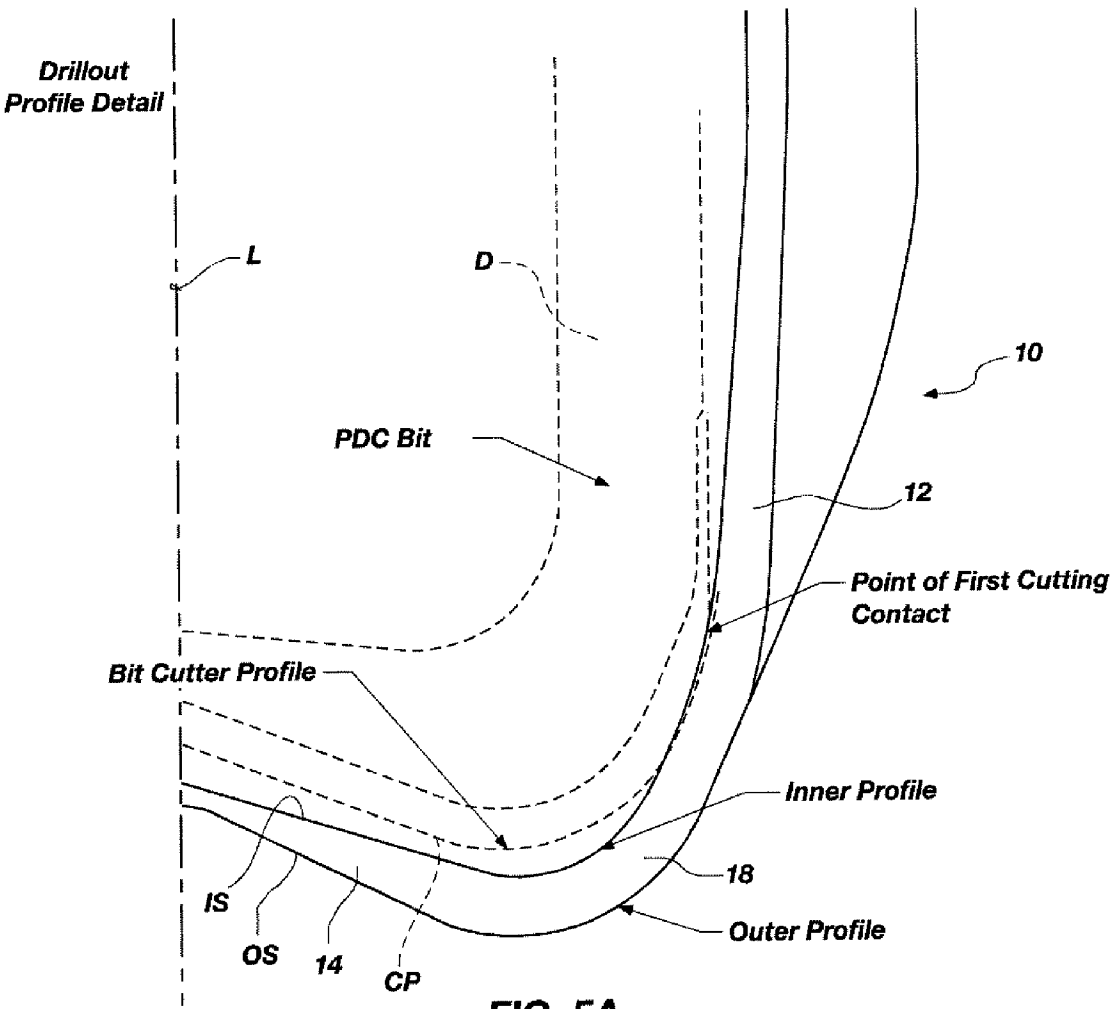
FIGS. 5A through 5C are schematic depictions of a quarter-section of the reaming tool of the present invention, as depicted in FIGS. 1 and 2 as a conventional PDC rotary drag hit approaches and drills through the nose, depicting how drillout is effected from the centerline of the nose of the reaming tool toward the side wall of the body.
Figure 5B:
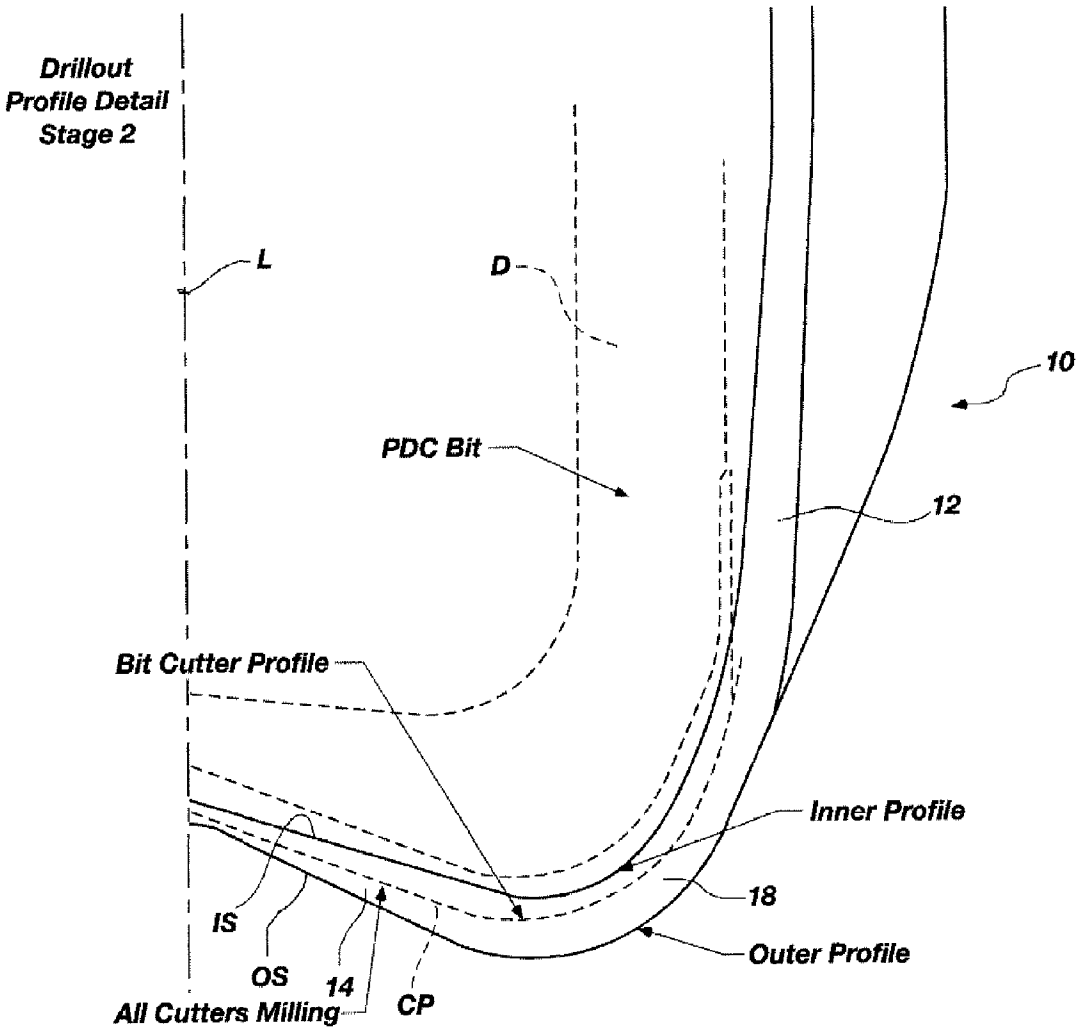
Figure 5C:
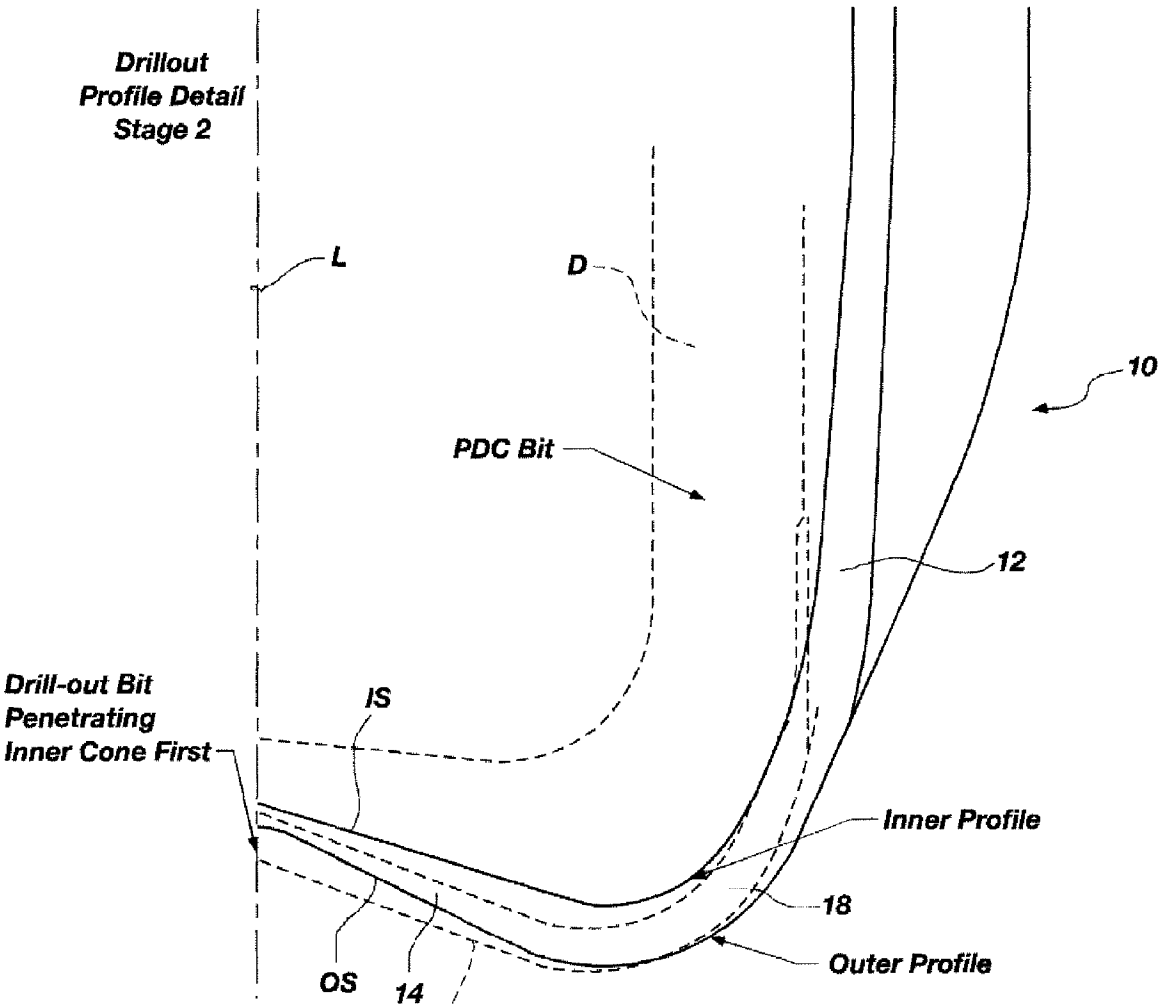

Referring now to FIGS. 5A-5C, FIG. 5A depicts an outer, face cutter profile of a conventional PDC rotary drag bit D disposed within body 12 of reaming tool 10 before rotary drag bit D engages the inner surface IS of nose 14. The PDC cutting elements carried on the face of rotary drag bit D and which together exhibit a cutter profile CP substantially the same as face profile while being exposed thereabove, have been omitted for clarity. In FIG. 5B, rotary drag bit D has engaged the inner surface IS of nose 14, and has partially drilled therethrough. As can be seen, the inner surface IS of central, concave portion of nose 14 exhibits a similar cone angle to that of cutter profile CP, while the outer surface OS thereof exhibits a steeper cone angle, resulting in a thinner shell proximate the centerline L of reaming tool 10, and ensuring that the portion of nose 14 will be drilled out from centerline L toward transition shoulder wall 18, which will be drilled out last, ensuring the absence of any large material segments from nose 14. As noted previously, the PDC cutting elements 30 (not shown in FIGS. 5A-5C) are completely removed from and radially outward of the drillout diameter of rotary drag bit D. FIG. 5C depicts completion of drillout of the concave portion of nose 14 and partial drillout of transition shoulder wall 18, the radially inward-to-outward drillout pattern ensuring that no uncut segments of nose 14 remain after drillout.

While the present invention has been described in the context of an illustrated, example embodiment, those of ordinary skill in the art will recognize and appreciate that the invention is not so limited. Additions and modifications to, and deletions from, the described embodiments within the scope of the invention will be readily apparent to those of ordinary skill in the art.

What is claimed is:

1. A reaming tool, comprising:

a substantially tubular body having a concave nose portion extending to a side wall through a substantially arcuate shoulder transition region;

a plurality of circumferentially spaced, spirally configured blades on an exterior of the body extending from proximate the shoulder transition region and defining junk slots therebetween, an axially leading end of each blade commencing with substantially no standoff and tapering radially outwardly to a portion having a substantially constant standoff and having a radially inwardly extending, beveled, axially trailing end; and cutting structure configured and positioned on the side wall of the substantially tubular body for contact with a bore hole side wall, the cutting structure comprising a plurality of cutting elements disposed along a rotationally leading edge of each blade of the plurality proximate an axially leading end thereof.

2. The reaming tool of claim 1, wherein the concave nose portion includes at least one port therethrough extending to an interior of the body.

3. The reaming tool of claim 1, further comprising at least one bearing element on each blade of the plurality, located proximate the axially leading end thereof and rotationally trailing the plurality of cutting elements thereon.

4. The reaming tool of claim 3, further comprising a layer of tungsten carbide proximate the axially leading end of each blade and rotationally trailing the at least one bearing element.

5. The reaming tool of claim 1, further comprising a plurality of additional ports extending through the arcuate shoulder transition region extending to the interior of the body, each port being substantially circumferentially aligned with a junk slot.

6. The reaming tool of claim 1, wherein the beveled, axially trailing end of each blade of the plurality carries a layer of crushed tungsten carbide thereon.

7. The reaming tool of claim 1, wherein a rotationally leading edge of each blade of the plurality axially trailing the plurality of cutting elements is tapered and relatively nonaggressive.

8. The reaming tool of claim 1, wherein at least a portion of a radially outer surface of each blade of the plurality is covered with tungsten carbide.

9. The reaming tool of claim 1, wherein portions of each blade adjacent rotationally leading and trailing edges thereof are covered with tungsten carbide.

10. The reaming tool of claim 1, wherein a pitch of the spiral configuration of the blades of the plurality is sufficiently steep to provide at least substantially full circumferential coverage of the blades about the body.

11. The reaming tool of claim 1, wherein the plurality of cutting elements comprises cutting elements selected from the group consisting of PDC cutting elements, TSP diamond cutting elements, diamond impregnated cutting elements, CBN cutting elements, and WC cutting elements.

12. The reaming tool of claim 1, wherein a central portion of the concave nose portion exhibits a thinner wall than a peripheral portion of the concave nose portion.

13. The reaming tool of claim 12, wherein a wall thickness of at least the central portion of the concave nose portion gradually increases from a center thereof radially outwardly toward the peripheral portion thereof.

14. The reaming tool of claim 1, wherein an inner surface of the concave nose portion is configured, in cross-section, to be engaged initially by a cutter profile of a conventional PDC drill bit disposed within the reaming tool proximate the central portion of the inner surface.

15. The reaming tool of claim 14, wherein the concave nose portion exhibits a wall thickness proximate a central portion thereof less than a wall thickness proximate a peripheral portion thereof.

16. The reaming tool of claim 1, wherein an inner surface of the concave nose portion is configured to center a conventional PDC bit disposed within the reaming tool and in contact therewith.

17. The reaming tool of claim 16, wherein the concave nose portion exhibits a wall thickness proximate a central portion thereof less than a wall thickness proximate a peripheral portion thereof.

18. The reaming tool of claim 4, wherein the at least one bearing element comprises a tungsten carbide ovoid.

19. The reaming tool of claim 3, wherein the at least one bearing element comprises a superabrasive, substantially hemispherical surface.

20. A reaming tool, comprising:

a substantially tubular body having a concave nose portion having no blades extending thereover and being devoid of cutting structure thereon, the concave nose portion extending to a side wall through a substantially arcuate shoulder transition region;

a plurality of circumferentially spaced, spirally configured blades on an exterior of the body extending from proximate the shoulder transition region and defining junk slots therebetween, an axially leading end of each blade commencing with substantially no standoff and tapering radially outwardly to a portion having a substantially constant standoff and having a radially inwardly extending, beveled, axially trailing end; and cutting structure disposed along a rotationally leading edge of each blade of the plurality proximate an axially leading end thereof.

21. The reaming tool of claim 20, further comprising at least one bearing element on each blade of the plurality, located proximate the axially leading end thereof and rotationally trailing the plurality of cutting elements thereon.

22. The reaming tool of claim 21, further comprising a layer of tungsten carbide proximate the axially leading end of each blade and rotationally trailing the at least one bearing element.

23. The reaming tool of claim 20, wherein the concave nose portion includes at least one port therethrough extending to an interior of the body, and further comprising a plurality of additional ports extending through the arcuate shoulder transition region extending to the interior of the body, each port being substantially circumferentially aligned with a junk slot.

24. The reaming tool of claim 20, wherein the beveled, axially trailing end of each blade of the plurality carries a layer of crushed tungsten carbide thereon.

25. The reaming tool of claim 20, wherein a rotationally leading edge of each blade of the plurality axially trailing the plurality of cutting elements is tapered and relatively nonaggressive.

26. The reaming tool of claim 20, wherein at least a portion of a radially outer surface of each blade of the plurality is covered with tungsten carbide.

27. The reaming tool of claim 20, wherein portions of each blade adjacent rotationally leading and trailing edges thereof are covered with tungsten carbide.

28. The reaming tool of claim 20, wherein a pitch of the spiral configuration of the blades of the plurality is sufficiently steep to provide at least substantially full circumferential coverage of the blades about the body.

29. The reaming tool of claim 20, wherein the cutting structure comprises cutting elements selected from the group consisting of PDC cutting elements, TSP diamond cutting elements, diamond impregnated cutting elements, CBN cutting elements, and WC cutting elements.

* * * * *